US005291922A

United States Patent [19]

Martin et al.

[11] Patent Number: 5,291,922

[45] Date of Patent: Mar. 8, 1994

[54] VACUUM ASSISTED LOADING SYSTEM

[75] Inventors: David N. Martin, Royal Oak, Mich.; Michael C. McCreery, Mineral Wells, Tex.

[73] Assignee: Mobil Oil Corporation, Fairfax, Va.

[21] Appl. No.: 871,462

[22] Filed: Apr. 21, 1992

[51] Int. Cl.[5] ..... B65B 31/00

[52] U.S. Cl. ..... 141/59; 141/65; 141/387; 96/174

[58] Field of Search ..... 141/59, 44, 45, 46, 141/51, 61, 387, 55, 65; 55/88, 213, 21, 55, 182, 163, 164, 189; 137/387, 388, 389

[56] References Cited

U.S. PATENT DOCUMENTS

| | | | |
|---|---|---|---|
| 3,996,975 | 12/1976 | Hansel | 141/45 |
| 4,058,147 | 11/1977 | Stary et al. | 141/59 |
| 4,058,148 | 11/1977 | Potter | 141/349 |
| 4,082,122 | 4/1978 | McGahey | 141/59 |
| 4,197,096 | 4/1980 | Sebastian et al. | 55/163 |
| 4,253,503 | 3/1981 | Gunn | 141/59 |
| 5,151,111 | 9/1992 | Tees et al. | 141/59 |

*Primary Examiner*—Henry J. Recla
*Assistant Examiner*—Steven O. Douglas
*Attorney, Agent, or Firm*—A. J. McKillop; M. D. Keen

[57] ABSTRACT

A vacuum assisted system for loading a liquid product containing vapor into a tank comprising apparatus for loading the liquid product under pressure into the tank, and a system for disposing of vapor recovered from the tank during loading. The system also includes conduit for interconnecting the tank and the vapor disposal, and a blower in the conduit for applying a predetermined vacuum to the tank. The loading apparatus pressure and the blower vacuum act to move vapor from the tank to the vapor disposal. A by-pass conduit is formed about and between the outlet and the inlet sides of the blower, and a valve is provided in the by-pass conduit which is responsive to the vacuum at the inlet side of the blower for progressively opening to permit by-pass flow of vapor from the outlet side to the inlet side of the blower. The valve provides maximum by-pass when the vacuum approaches a predetermined maximum level.

19 Claims, 4 Drawing Sheets

VACUUM ASSISTED LOADING SYSTEM

BACKGROUND OF THE INVENTION

1. Field of the Invention

The present invention relates to a vacuum assisted system for loading a liquid product into a tank. More particularly, the present invention relates to vacuum assisted system for use on tanker loading racks in a petroleum product terminal.

2. Description of Prior Art

Vacuum assisted loading systems for use on loading racks and product terminals are provided to reduce vapor emissions. In these vacuum systems, the vapor expelled from a tank, truck or car during petroleum product loading are withdrawn through a vacuum hose and passed to a vapor recovery system which may either sorb the hydrocarbons in a sorbent bed or incinerate the hydrocarbons in a burner. The prime mover of the vapor from the tank to the vapor recovery system is the pressure of the product being loaded in the tank which may be in the order of thousands of gallons per minute. In prior emission recovery systems, the vapor recovery hose was hooked by a standard coupling to the tank. This coupling was not designed to be vapor or leak proof. Accordingly there was a significant amount of vapor escaping through the coupling. Some jurisdictions have a requirement that a vacuum be placed on the vapor recovery hose. This requirement may be that a minimum vacuum of −8.5" water be maintained on the vapor recovery hose while a tank is being loaded with a petroleum product. However, a maximum value is inherent and is set by the tank structure. Specifically, excessive vacuum may cause tank cells to collapse.

In one system, a large blower is installed in a header which ran overhead of a plurality of tanker loading bays, each bay having a downwardly extending conduit rig for connection to the tank of a tanker truck in a specific bay. This system senses the pressure in each downwardly extending loading system in each bay, and should the vacuum exceed what is needed in a specific bay the downwardly extending conduit system would be closed off from the overhead header. This system requires a relatively large and complex control scheme. Further, by taking a bay conduit system out of the vacuum scheme there is raised a possibility that there will be large variations in the header vacuum level. These variations will cause large fluctuations in liquid loading. One prior system includes an incinerator, and it is preferable to maintain a relatively constant hydrocarbon to air ratio to insure optimum combustion.

SUMMARY OF THE INVENTION

In accordance with the present invention, there is provided a vacuum assisted system for loading a liquid product containing vapor into a tank comprising means for loading the liquid product under pressure into the tank, and means for disposing of vapor recovered from the tank during loading. The system also includes conduit means for interconnecting the tank and the vapor disposing means, and a blower in the conduit means for applying a predetermined vacuum to the tank. The loading means pressure and the blower vacuum act to move vapor from the tank to the vapor disposal means. A by-pass conduit is formed about and between the outlet and the inlet sides of the blower, and valve means are provided in the by-pass conduit which is responsive to the vacuum at the inlet side of the blower for progressively opening to permit by-pass flow of vapor from the outlet side to the inlet side of the blower. The valve means provides maximum by-pass when the vacuum approaches a predetermined maximum level.

In a more specific embodiment, each bay of a multi-bay loading racks and products terminal has a vacuum assisted system in accordance with the present invention. By providing a blower in each bay with a by-pass system, the present invention provides for closed-circuit recycling which maintains a relatively constant vacuum, a constant load on the blower and reduces variations in vapor composition and loading rates.

DESCRIPTION OF SPECIFIC EMBODIMENTS

Figure 1:
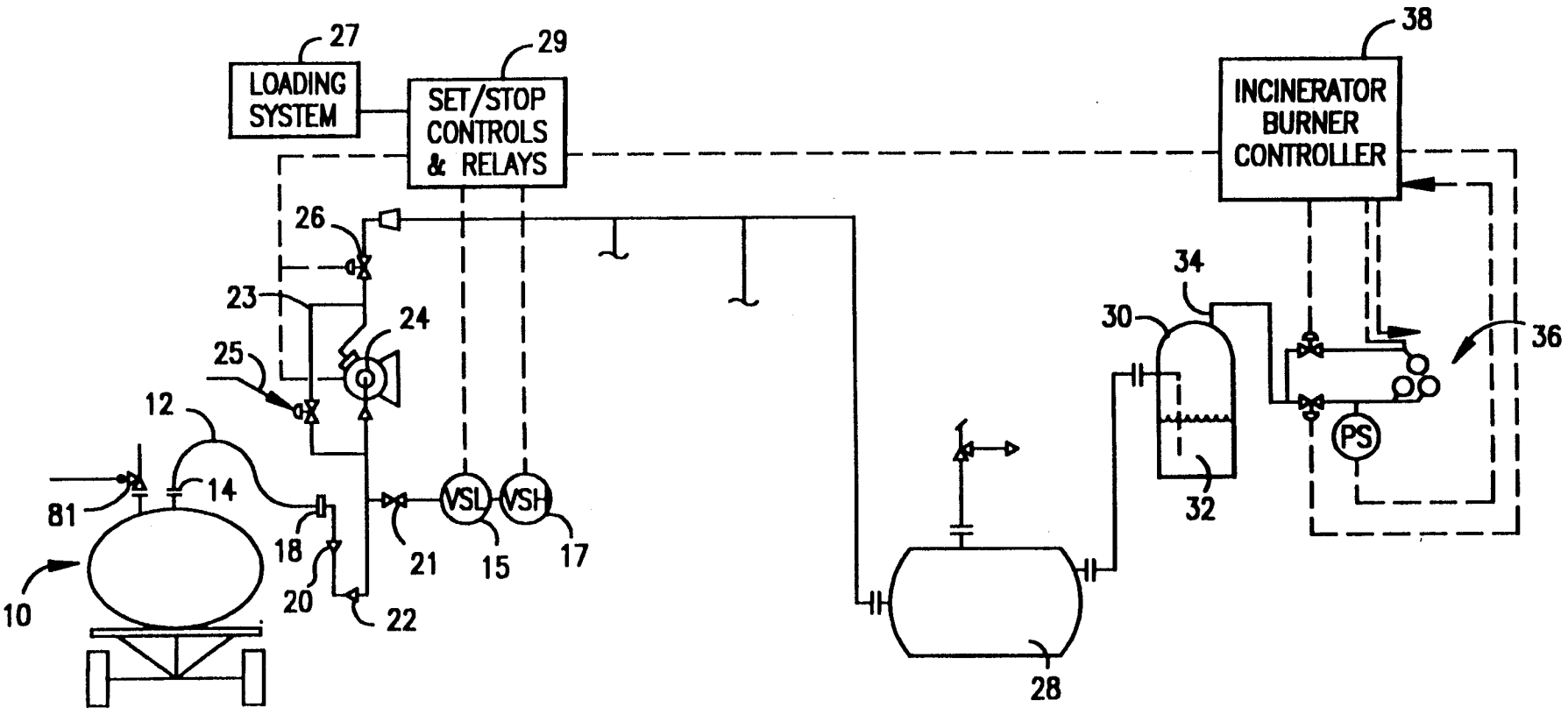
FIG. 1 shows a schematic drawing of a vacuum assisted loading system in accordance with the present invention.

With reference to FIG. 1, there is provided a tanker 10 having attached thereto an embodiment of the vapor assisted loading system of the present invention. Specifically, a vapor hose 12 is connected through a coupling 14 to the tank at one end thereof. The other end of the vapor hose 12 is fed through a coupling 18, a check valve 20, a pipe reducer 22, and to the inlet side of a vacuum suction fan 24. A by-pass line 23 extends from the outlet side of the fan 24 back to the inlet side of the fan. A vacuum breaker valve 25 is provided in the by-pass line 23 and is responsive to the vacuum at the inlet side of the fan 24 for progressive opening in response to increasing vacuum to permit a corresponding increase by-pass vapor flow from the outlet to the inlet side of the fan 24.

The outlet side of the fan 24 is also connected through a bay isolation valve 26 which takes the vacuum part of the bay out of the system in the event the bay is out of service. From the isolation valve 26 , the line passes through a pipe reducer to a knockout tank 28 wherein liquids are permitted to settle, and are drawn off by piping (not shown). The vapor is pumped under the pressure of the product loading system 27 and the vapor suction fan 24 to pump the vapor downwardly into a fire stop 30 through water 32 and outlet 34. The vapor is then feed to an incinerator 36 operated by an incinerator burner controller 38. A suitable incinerator burner controller is manufactured by the John Zink Company.

The product loading system 27 is connected to a control and relay system 29. A suitable control and relay system is manfactured by the Hardi Company. Also connected to the control and relay system 29 are the outputs of a vacuum manometer control 21. These outputs are vacuum low and high set points 15,17 which may be −8.5" and −10" of water, respectively. When either one of these levels are reached as a result of the vacuum falling or rising, a respective one of set points 15,17 sends a signal to the control and relay system 29, and in turn to the loading system 27 to stop loading the tanker 10.

Figure 2:
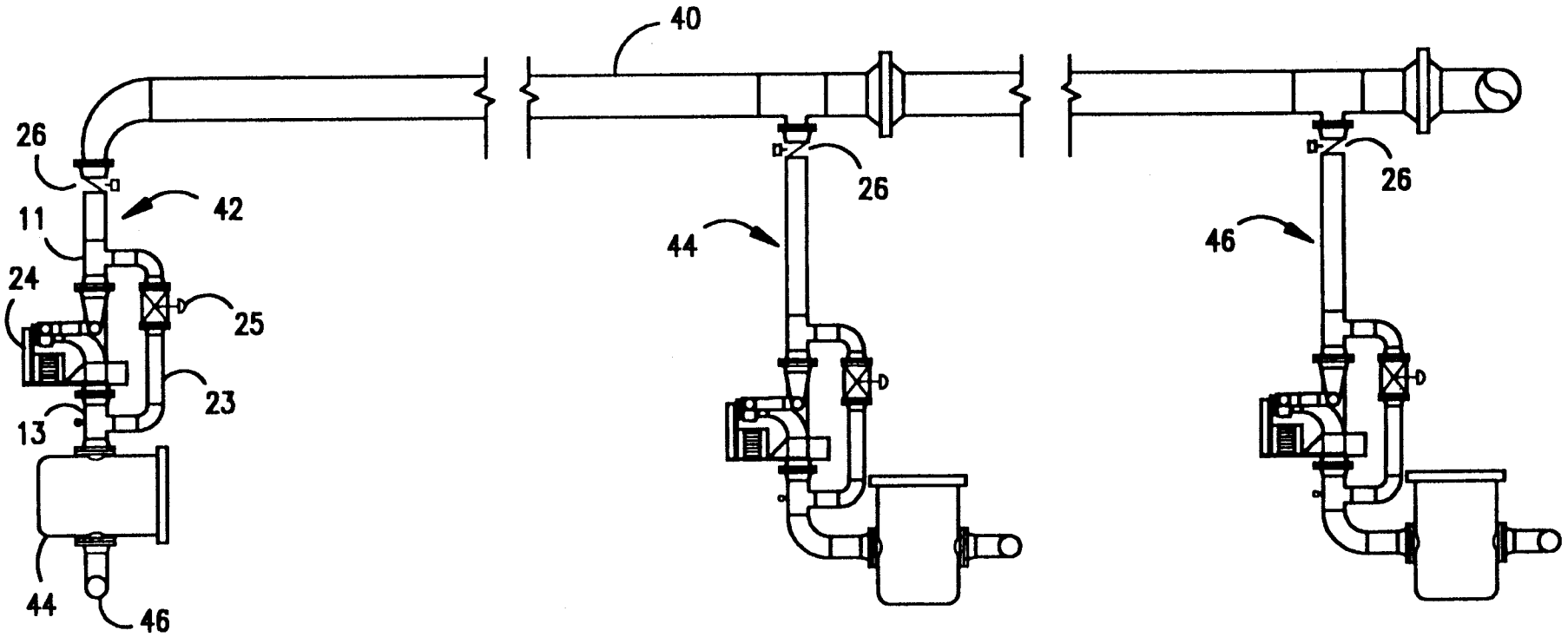
FIG. 2 is an elevation view of a vacuum header system extending over three bays.

With reference to FIG. 2, there is shown a bay area header 40 extending across and above three bays. Each bay has a vacuum manifold system 42,44,46 for connection to a tanker positioned the respective bay. Each manifold system 42,44,46 passes through a bay isolation valve 26 which, as noted above, is capable of isolating the bay and taking it out of the pneumatic vacuum system. From the bay isolation valve 26 , the piping extends to the outlet side 11 of the fan or blower 24. The inlet side 13 of the blower 24 is in turn connected to a flame arrester unit 44 which is well known in the art to prevent passage a flame therethrough in either direction. The flame arrester 44 is connected by piping 46 to a vapor arm assembly 48 (FIG. 4).

Figure 4:
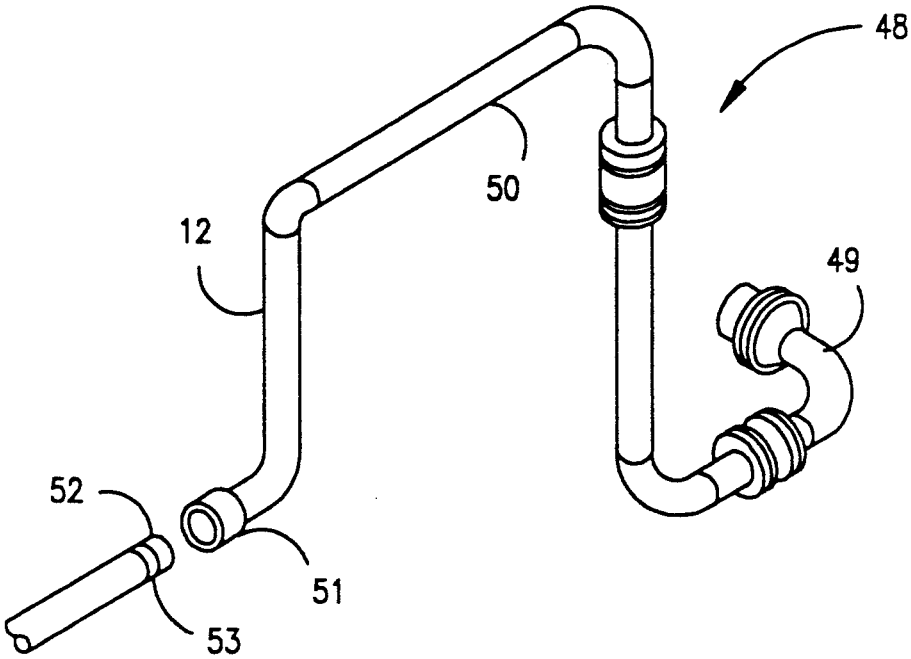
FIG. 4 is an isometric view of a vapor arm for a bay which connects to and couples with a vapor manifold in a tanker truck.

With reference to FIG. 4, the vapor arm assembly 48 includes an elbow portion 49 which interconnects the flame arrester 44 and an upwardly extending portion 50 connected to a standard vapor hose 12. The vapor hose 12 has a female coupling 51 at its outer end which mates to a male coupling 52 on the tanker 10. The male coupling 52 has an annulus 53 which receives arms 55 on the female coupling 51 therein to provide a seal. This coupling 51,52 is a KAM-LOK connector which is an oil industry standard. The KAM-LOK is not designed to be a vapor tight connection. Thus, there has been fugitive vapor emissions through this coupling 51,52 as well as other venting points, e.g. 81 (FIG. 1), which are not wanted by either the oil industry or the governmental environmental authorities. The system provided by the present invention is designed to avoid leakage about this coupling.

Figure 5:
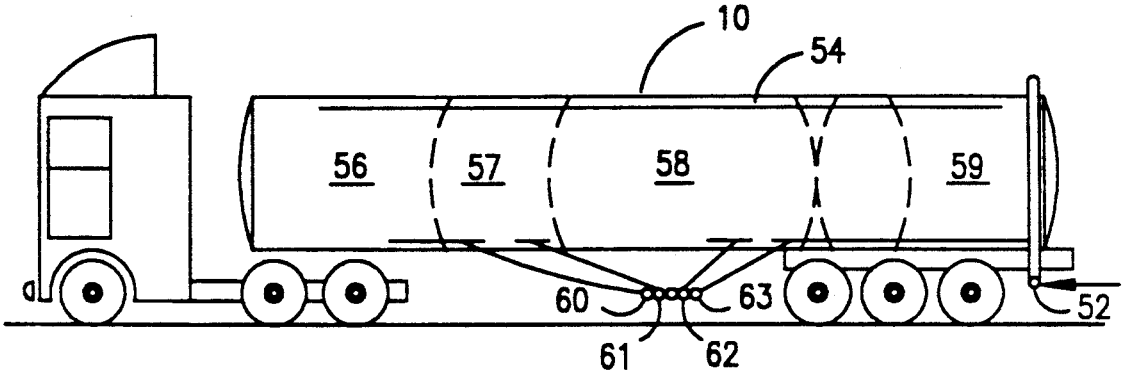
FIG. 5 is a schematic representation of a multi-compartmented tanker truck.

With reference to FIG. 5, the tank 10 is divided into four compartments 56–59. There is a common vapor line 54 passing through each compartment 56–59 and exiting at the lower rear end of the tanker 10 as the male coupling 52. The input to each compartment are shown diagrammatically at 60–63 at the lower middle section of the tank 10, and are adapted to mate with liquid line connectors in the loading system 27, e.g. Enco-Wheaton J471.

Figure 3:
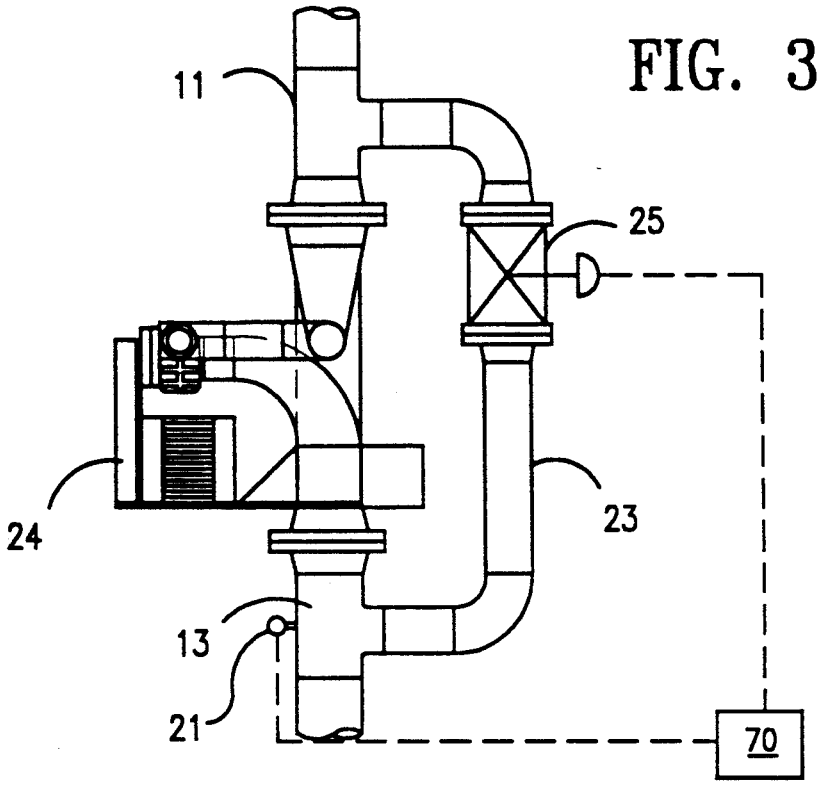
FIG. 3 shows a blower with a by-pass system to control vacuum in a bay line in accordance with the present invention.

With reference to FIG. 3, there is shown in greater detail the blower 24, vacuum breaker valve 25, vacuum manometer control 21, and by-pass line 23. FIG. 3 also includes an alterative wherein the vacuum manometer control 21 generates a siginal responsive to the vacuum level at the inlet end 13 of the blower 24 and this signal is applied to a signal comparator 70 which in turn generates a signal to control the breaker valve 25 opening and thereby stabilize the vacuum pressure.

Figure 6:
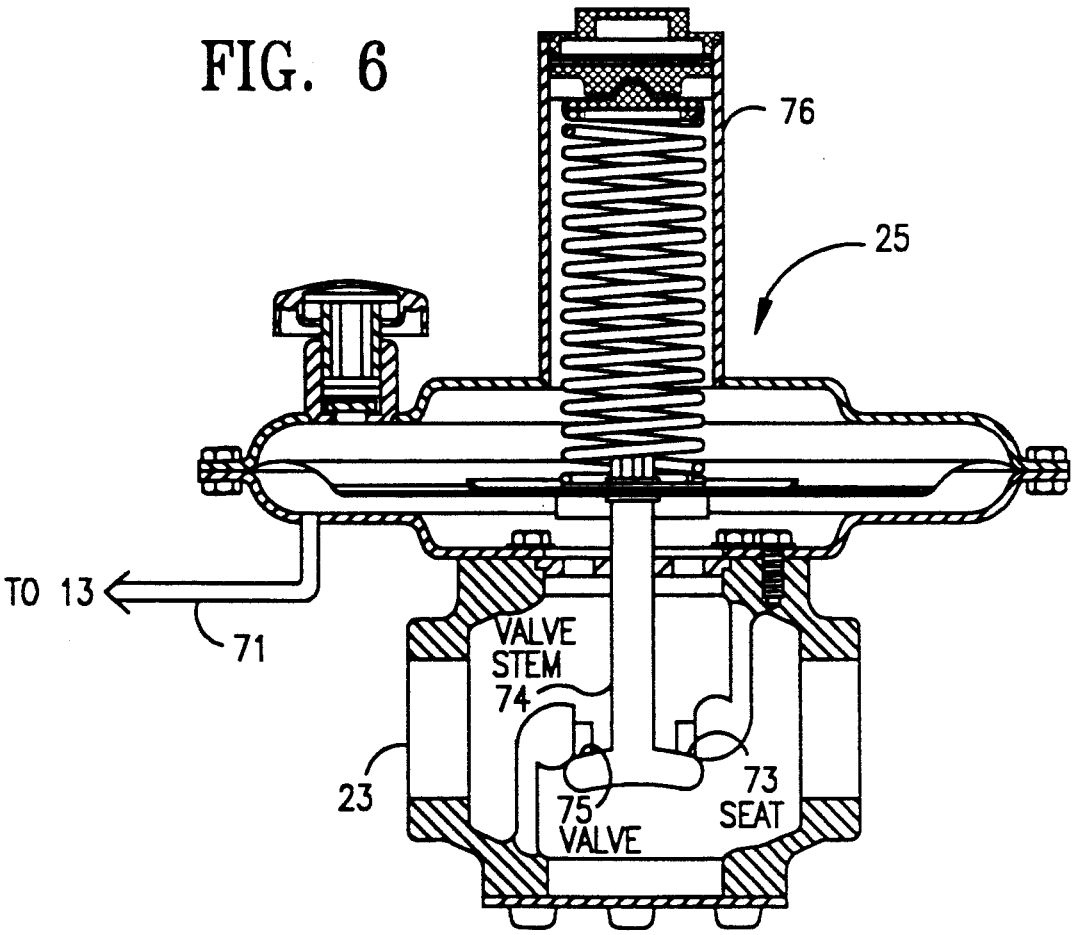
FIG. 6 is a sectional view of a vacuum breaker valve used in various embodiments of the present invention.

FIG. 6 is a modified Fisher valve No. 661 manufactured by the Fisher Valve Company, and functions as the vacuum breaker valve 25. Vacuum line 71 is connected to sense the vacuum level at the inlet side 13 of the blower 24. A diaphragm 72 is drawn downwardly under the bias of a spring 76 in response to an increase in vacuum as sensed by line 71. Downward movement of the diaphragm 72 moves the valve stem 74 downwardly and the valve 75 away from valve seat 73 to increase by-pass flow in by-pass line 23. Conversly, a decrease in sensed vacuum acts to move the valve stem 74 upwardly as the spring 76 and diaphragm 72 relax to pull the valve 75 toward or to the valve seat 73.

The modification of the Fisher valve involved changing the valve from seating on top of the valve seat in response to downward pressure of the spring to the configeration shown in FIG. 6. By configuring the valve 25 as shown in FIG. 6, the valve 75 will fall away from the valve seat 73 in the event the spring 76, the diaphragm 72 or the stem 74 break or otherwise fail.

In operation, a truck is driven into a loading bay and a driver or operator connects the vapor hose 12 (FIG. 4) to a tanker 10 (FIG. 5) by connecting the male coupling 52 on the tanker to the female coupling 51 on the hose 12. The loading system 27 is connected to at least one of the product inlets 60–63 (FIG. 5). A switch (not shown) is then actuated which starts a vacuum by the blower 24 which draws a vacuum from the tanker compartments 56–59. The product will not begin loading until the vacuum reaches a predetermined minimum, e.g. −8.5". When it reaches −8.5" a signal is generated by the low set point output 15 to the System Control and Relays 29 which in turn sends a signal out to the loading system 27 to initiate pumping action.

The loading rate may be in the range of 1,000 to 3,000 gallons/minute. This high flow rate of product, e.g. gasoline, creates some instability or fluctuation of vacuum at the inlet 13 to the blower 24. The vacuum level at the vacuum manometer control 21 also fluctuates as a result of the pumping action. Vacuum breaker valve 25 senses this change in vacuum at the blower inlet 13 and adjusts its opening to modulate the vacuum at the inlet 13 and maintain it at some predetermined setting, e.g. −9.2". There may be an aspect of hunting about the set point. The amount of opening of valve 25 is correlated to the vacuum at the inlet 13. For example, as the vacuum increases from −8.5" to −10", the valve will gradually open further to permit a gradual increase in by-pass flow of vapor around the by-pass 23.

With reference to FIG. 1, the valve 81 is both a pressure and a vacuum sensor safety valve, and is an emergency relief valve to open the inside of the thin aluminum shell structure to atmosphere and to provide relief either at the low end of the range, e.g. −13.0" vacuum, or at the high end, e.g. 1 psi of pressure. Vacuum manometer control 21 senses the vacuum at 13 and will not give a release to the pump apparatus in the loading system 27 to load the tanker until it senses a predetermined level of vacuum in the pipe, e.g. −8.5". Then the vacuum manometer control 21 sends a signal to open a normally closed flow control valve in the loading assembly 27. When the vacuum manometer control senses a too high of a value of vacuum, e.g. −10", it sends a signal to the flow control valve or other element in the system to prevent loading of the truck.

Obviously, many other variations and modifications of this invention as previously set forth may be without departing from the spirit and scope of this invention as those skilled in the art readily understand. Such variations and modifications are considered part of this invention and within the purview and scope of the appended claims.

What is claimed is:

1. A vacuum assisted system for loading a liquid product containing vapor into a tank comprising:

means for loading the liquid product under pressure into said tank;

means for disposing of vapor recovered from said tank during loading;

conduit means for interconnecting said tank and said vapor disposing means;

a blower in said conduit means for applying a predetermined vacuum to said tank, whereby the loading means pressure and the blower vacuum act to move vapor from the tank to the vapor disposal means;

a by-pass conduit formed between the outlet and the inlet sides of said blower; and valve means in said by-pass conduit and responsive to the vacuum at the inlet side of said blower for progressively opening to permit by-pass flow of vapor from the outlet side to the inlet side of said blower, whereby maximum by-pass is provided when the vacuum approaches a predetermined maximum level;

said valve means comprising a valve seat, a valve stem extending through said valve seat, a valve at one end of said stem, a spring at the other end of said valve stem for biasing said valve against said valve seat, and a diaphragm interposed between said spring and said valve seat for pulling said valve stem away from said spring to progressively open said valve in response to an increasing vacuum.

2. The system of claim 1 further comprising means for sensing vacuum at the inlet side of said blower and enabling said loading means to operate only when the vacuum is above a predetermined minimum value and below a predetermined maximum value.

3. The system of claim 2 wherein said vacuum sensing means provides a signal to said valve means to control the by-pass flow of vapor.

4. The system of claim 1 wherein said valve means is constructed for said valve to remain in an open position in the event of said stem, said spring or said diaphragm failing.

5. The system of claim 1 wherein said valve means further comprises a vacuum line interconnecting the inlet side of said blower and said diaphragm whereby an increase in sensed vacuum will pull said diaphragm toward said valve seat.

6. The system of claim 1 wherein said loading means loads the liquid product at the rate of from about 1,000 to about 3,000 gallons/minute.

7. The system of claim 6 wherein the blower vacuum is in the range of from about −8.5″ to about −10″ of water.

8. The system of claim 1 wherein the blower vacuum is in the range of from about −8.5″ to about −10″ of water.

9. The system of claim 1 wherein said disposing means comprises means for separating liquids from said recovered vapor.

10. The system of claim 1 wherein said disposing means comprises means for incinerating said recovered vapor.

11. A vacuum assisted system for loading liquid product containing vapor into a plurality of tanks comprising:

a plurality of tanker loading bays, a header, and means connected to one end of said header for disposing of vapor recovered from the tanks, each one of said bays including the following:

means for loading the liquid product under pressure into a tank;

conduit means for interconnecting said tank and said header;

a blower in said conduit means for applying a predetermined vacuum to said tank, whereby the loading means pressure and the blower vacuum act to move vapor from said tank through said header to said vapor disposing means;

a by-pass conduit formed between the outlet and the inlet sides of said blower; and valve means in said by-pass conduit and responsive to the vacuum at the inlet side of said blower for progressively opening to permit by-pass flow of vapor from the outlet side to the inlet side of said blower, whereby maximum by-pass is provided when the vacuum approaches a predetermined maximum level.

12. The system of claim 11 wherein each one of said bays further comprises means for sensing vacuum at the inlet side of said blower and enabling said loading means to operate only when the vacuum is above a predetermined minimum value and below a predetermined maximum value.

13. The system of claim 11 wherein said valve means comprises a valve seat, a valve stem extending through said valve seat, a valve at one end of said stem, a spring at the other end of said valve stem for biasing said valve against said valve seat, and a diaphragm interposed between said spring and said valve seat for pulling said valve stem away from said spring to progressively open said valve in response to an increasing vacuum.

14. The system of claim 13 wherein said valve means is constructed for said valve to remain in an open position in the event of said stem, said spring or said diaphragm failing.

15. The system of claim 13 wherein said valve means further comprises a vacuum line interconnecting the inlet side of said blower and said diaphragm whereby an increase in sensed vacuum will pull said diaphragm toward said valve seat.

16. The system of claim 11 wherein said loading means loads the liquid product at the rate of from about 1,000 to about 3,000 gallons/minute.

17. The system of claim 16 wherein the blower vacuum is in the range of from about −8.5″ to about −10″ of water.

18. The system of claim 11 wherein said disposing means comprises means for separating liquids from said recovered vapor.

19. The system of claim 11 wherein said disposing means comprises means for incinerating said recovered vapor.

* * * * *